US005399064A

United States Patent [19]

Church et al.

[11] Patent Number: 5,399,064

[45] Date of Patent: * Mar. 21, 1995

[54] TURBOCHARGER HAVING REDUCED NOISE EMISSIONS

[75] Inventors: Peter D. Church, Peoria; Phillip B. Gordon, Jr., Washington, both of Ill.

[73] Assignee: Caterpillar Inc., Peoria, Ill.

[ * ] Notice: The portion of the term of this patent subsequent to Mar. 22, 2011 has been disclaimed.

[21] Appl. No.: 179,000

[22] Filed: Jan. 7, 1994

Related U.S. Application Data

[62] Division of Ser. No. 996,414, Dec. 23, 1992, Pat. No. 5,295,785.

[51] Int. Cl.[6] ..... F04D 29/66

[52] U.S. Cl. ..... 415/58.3; 415/58.4; 415/119

[58] Field of Search ..... 415/58.2, 58.3, 58.4, 415/52.1, 119, 144, 914

[56] References Cited

U.S. PATENT DOCUMENTS

| | | | |
|---|---|---|---|
| 3,936,218 | 2/1976 | Fuller | 415/119 |
| 4,248,566 | 2/1981 | Chapman et al. | 415/26 |
| 4,479,755 | 10/1984 | Skoe | 415/119 |
| 4,743,161 | 5/1988 | Fisher et al. | 415/58.3 |
| 4,930,978 | 6/1990 | Khanna et al. | 415/58.3 |
| 4,981,018 | 1/1991 | Jones et al. | 415/58.3 |
| 5,246,335 | 9/1993 | Mitsubori et al. | 415/914 |
| 5,295,785 | 3/1994 | Church et al. | 415/58.3 |

FOREIGN PATENT DOCUMENTS

| | | | |
|---|---|---|---|
| 200487 | 1/1924 | United Kingdom | 415/119 |
| 1333859 | 8/1987 | U.S.S.R. | 415/119 |
| 1413294 | 7/1988 | U.S.S.R. | 415/119 |

*Primary Examiner*—Edward K. Look
*Assistant Examiner*—James A. Larson
*Attorney, Agent, or Firm*—Dennis C. Skarvan

[57] ABSTRACT

Turbocharger compressor wheels rotate at high speeds resulting in noise which is emitted therefrom. To widen the performance band of turbochargers certain efficiency improvements have increased the noise emitted therefrom above the normal level of acceptability by the operator and spectators. The present device for reducing noise emitted therefrom includes a noise reduction system. The system includes a series of deflector fins forming a torturous path between the series of deflector fins associated with the turbocharger compressor inlet and form a torturous path in a secondary inlet. The series of deflector fins have a preestablished spacing therebetween to further enhance the reduction of noise emitted from the turbocharger.

22 Claims, 8 Drawing Sheets

TURBOCHARGER HAVING REDUCED NOISE EMISSIONS

This is a divisional application of application Ser. No. 07/996,414, filed Dec. 23, 1992, U.S. Pat. No. 5,295,785.

TECHNICAL FIELD

This invention relates generally to internal combustion engines and more particularly to noise emissions from a turbocharger and to a passive noise reduction device adapted for use with the turbocharger.

BACKGROUND ART

The use of turbochargers to increase the air intake of internal combustion engines is a common, well known mean to increase engine output. In many conventional turbochargers the compressor wheel is driven at high speeds or revolutions per minute. For example, many turbocharger wheels rotate in the range of about 100,000 to 150,000 revolutions per minute. This high speed of the rotating blades causes a high frequency noise to be emitted therefrom. When such turbocharged engines are used in vehicular applications such as a truck, the noise can be very annoying and distasteful to the operator and by-standers. The use of insulation in cabs and in engine compartments has greatly reduced the amount of noise emitted from the turbochargers that reaches the operator and by-standers. To date, such noise reduction packages have managed to keep the objections by the operator and by by-standers to an acceptable level. However, certain performance improvements in turbochargers have increased the noise emitted therefrom above the normal level of acceptability by the operator and by-standers. Some examples of approaches to widening the performance band of turbochargers include variable geometry guide vanes and vaned diffusers, turbine bleed devices and valves, casing treatments and the addition of features such as axial and circular grooves.

One such example is disclosed, in U.S. Pat. No. 4,743,161 issued to Frank B. Fisher et al. on May 10, 1988. The goal of this enhancement is to allow operation over a wider speed and load range and also enable higher torque at lower engine speed. What is accomplished is a broadening of the high efficiency range between surge conditions and choke conditions. Surge being where a turbocharger/compressor/engine system is on the edge of instability and stall. Choke conditions being where the system's air requirements exceed the compressor's maximum flow capacity. In this patent, an inducer recirculation groove or bypass is disclosed. The bypass accomplishes two things; increases choke flow by drawing extra air into the stage after the compressor impeller throat, and reduces the flow at which surge occurs at all speeds by joining different parts of the compressor stage with bypass flow. The bypass includes a simple circumferential slot connecting a point along the shroud with a secondary inlet. The bypass produces a positive differential pressure on the inlet at choke and a negative differential pressure on the inlet at surge. The inducer recirculation groove has been found to increase the amount of noise emitted therefrom since the groove connects a point along the shroud with a secondary inlet. Thus, a secondary line of sight or path for the sound waves to pass therealong is constructed when using the inducer recirculation groove.

The problems mentioned above has caused increased negative comment by operators and by-standers. The problems have further caused manufacturers to consider alternatives to turbochargers and variations to noise reduction systems.

The present invention is directed to overcoming one or more of the problems as set forth above.

DISCLOSURE OF THE INVENTION

In one aspect of the invention, a turbocharger is comprised of an intake housing having an outer wall defining an intake opening therein and an inner wall positioned within the outer wall. A primary inlet is formed within the inner wall and an annular chamber is formed between the outer wall and the inner wall. A means for connecting is interposed the annular chamber and the primary inlet and forms a secondary inlet. A means for reducing noise emitted from the turbocharger is positioned in generally axial alignment with the annular chamber.

BEST MODE FOR CARRYING OUT THE INVENTION

Figure 1:
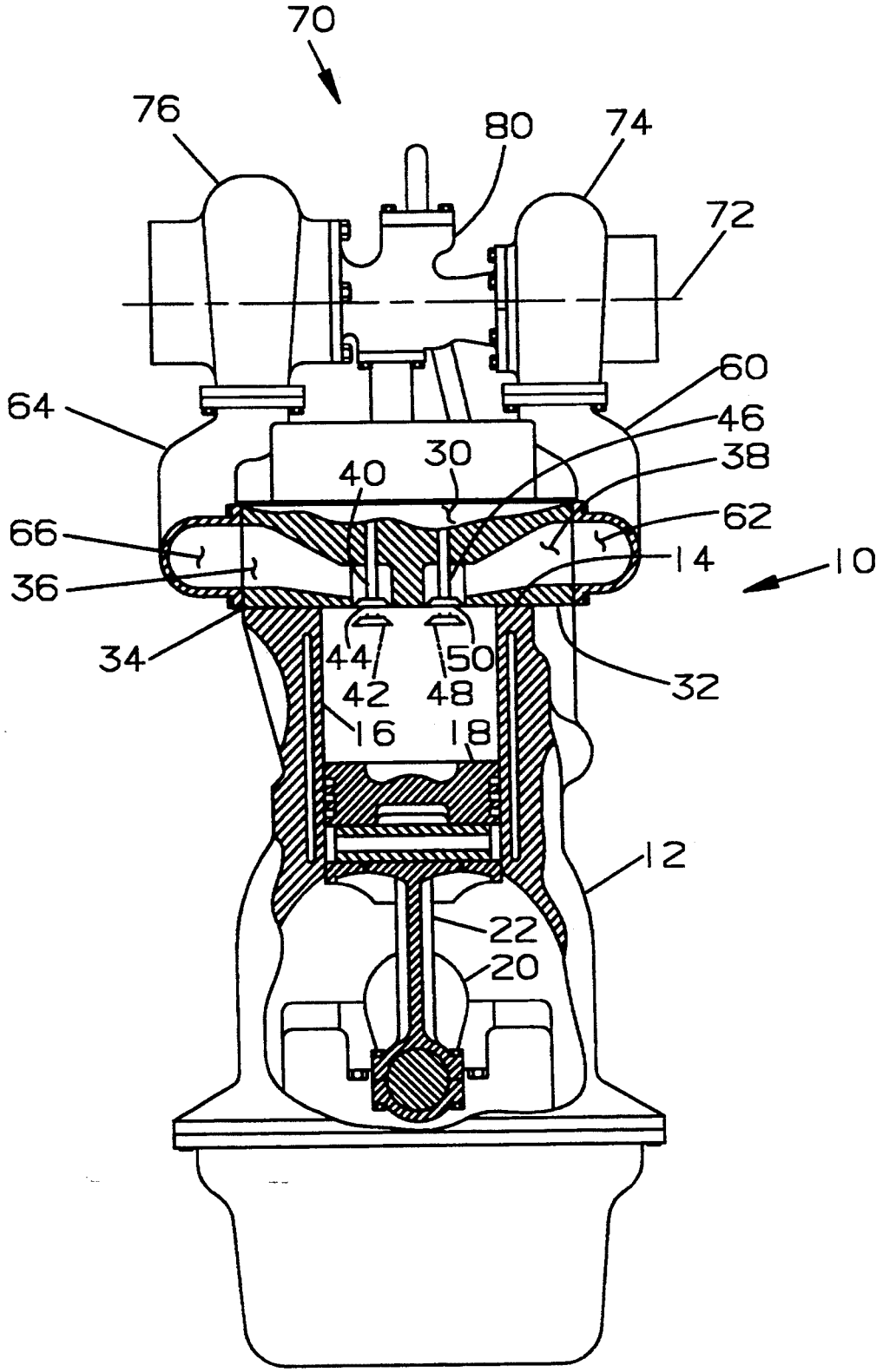
FIG. 1 is a partially sectioned end view of an engine disclosing a turbocharger including an embodiment of the present invention.

Referring to FIG. 1, an internal combustion engine 10 includes a block 12 having a top surface 14 defined thereon and a cylinder bore 16 extending from the top surface 14 and generally through the block 12. A piston 18 is reciprocatably positioned in the bore 16 of the block 12 in a conventional manner. A crankshaft 20 is rotatably positioned in the block 12 and has a connecting rod 22 attached between the crankshaft 20 and the piston 18.

A cylinder head 30 having a bottom surface 32 defined thereon is attached to the block 12 in a conventional manner. Interposed the bottom surface 32 and the top surface 14 of the block 12 is a gasket 34 of convention construction. The cylinder head 30 has a plurality of intake passages 36, only one shown, and a plurality of exhaust passages 38, only one shown, defined therein. Disposed in each of the plurality of intake passages 36 is an intake valve 40 having an open position 42, shown in phantom, in which the bore 16 is in communication with the intake passage 36 and a closed position 44 in which communication between the bore 16 and the intake passage 36 is prevented. Disposed in each of the plurality of exhaust passages 38 is an exhaust valve 46 having an open position 48, shown in phantom, in which the bore 16 is in communication with the exhaust passage 38 and a closed position 50 in which communication between the bore 16 and the exhaust passage 38 is prevented.

Attached to the cylinder head 30 in a conventional manner is an exhaust manifold 60 having a passage 62 defined therein being in communication with the exhaust passage 38 in the cylinder head 30. An intake manifold 64 is attached to the cylinder head 30 in a conventional manner and has a passage 66 defined therein which communicates with the intake passage 36.

Figure 2:
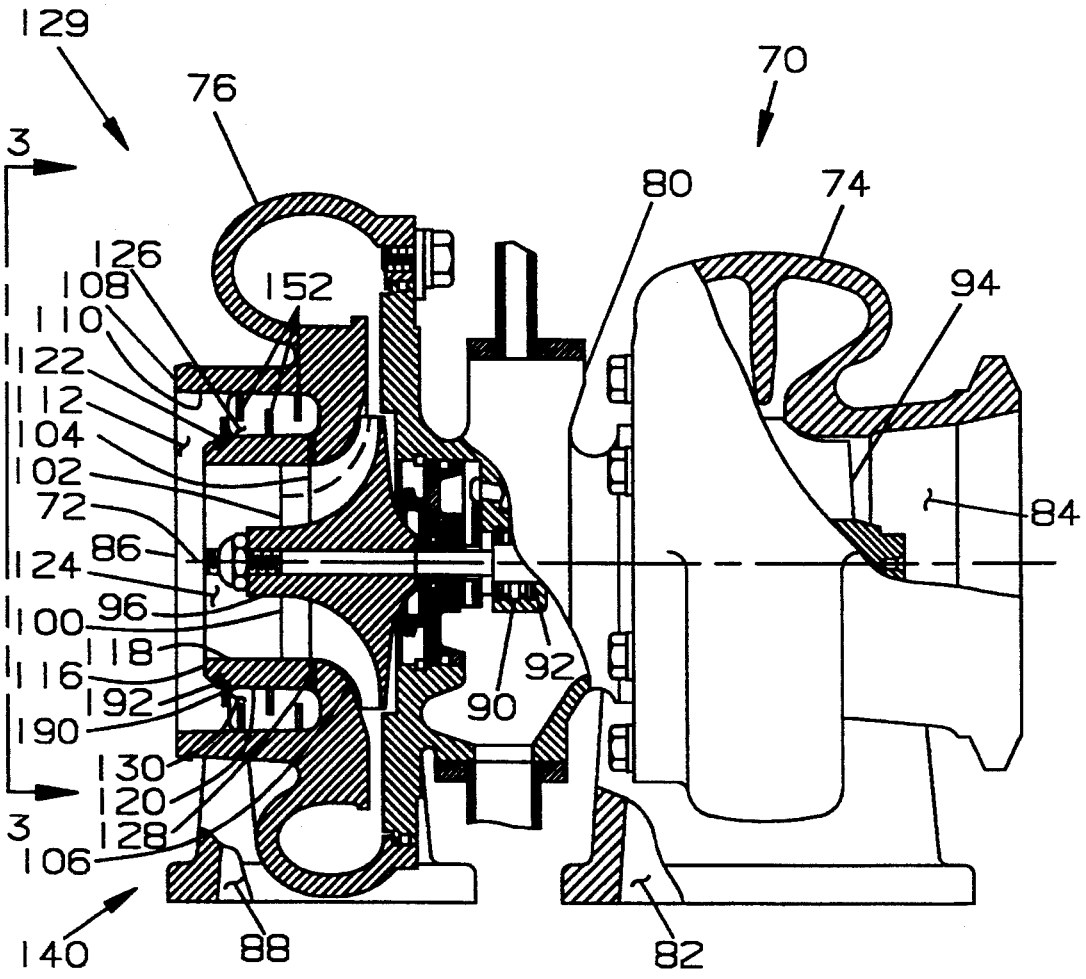
FIG. 2 is an enlarged partially sectioned view of the turbocharger of FIG. 1.

A turbocharger 70, as best shown in FIGS. 1 and 2, is attached to the engine 10 in a conventional manner. The turbocharger 70 includes an axis 72, an exhaust housing 74, an intake housing 76 and a bearing housing 80 interposed the exhaust housing 74 and the intake housing 76.

The exhaust housing 74 has an inlet opening 82 and an exhaust opening 84 defined therein. The exhaust housing 74 is positioned at one end of the turbocharger 70 and is removably attached to the exhaust manifold 60 in such a position so that the inlet opening 82 communicates with the passage 62 in the exhaust manifold 60.

The intake housing 76 has an intake opening 86 and an outlet opening 88 defined therein. The intake housing 76 is positioned at another end of the turbocharger 70 and is removably attached to the intake manifold 64 in such a position so that the outlet opening 88 communicates with the passage 66 in the intake manifold 64.

The bearing housing 80 has a plurality of bearings 90, only one shown, positioned therein in a conventional manner. The plurality of bearings 90 are lubricated and cooled in a conventional manner. A shaft 92 is positioned coaxial with the axis 72 and rotatably within the plurality of bearings 90. A turbine wheel 94 is attached at one end and a compressor wheel 96 is attached at the other end of the shaft 92. The turbine wheel 94 is positioned within the exhaust housing 74 and the compressor wheel 96 is positioned within the intake housing 76.

Figure 3:
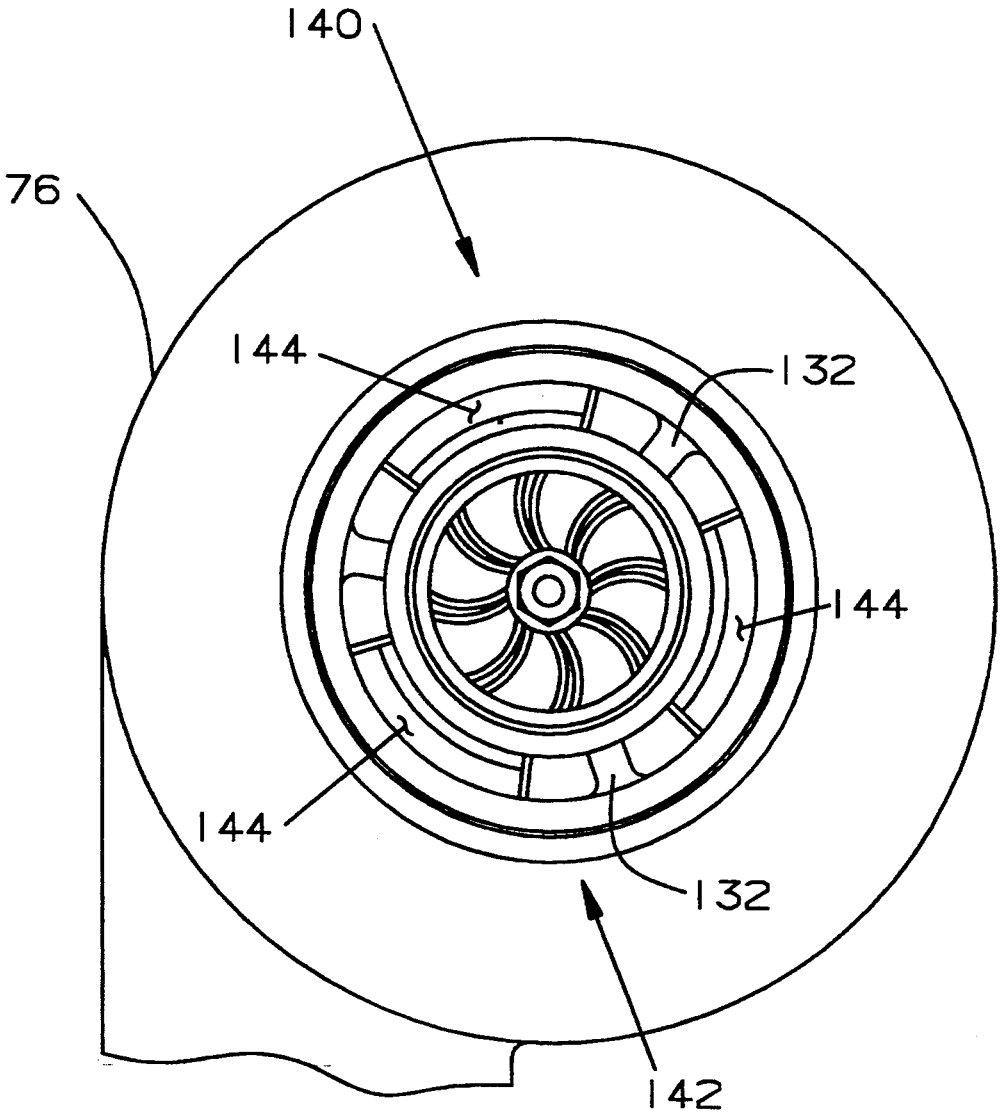
FIG. 3 is an end view of the turbocharger of the present invention taken along line 3—3 of FIG. 2.

The compressor wheel 96 includes a plurality of blades or vanes 100. A portion of the plurality of vanes 100 have a leading edge 102 and another portion of the plurality of vanes 100 have an offset leading edge 104 axially spaced downstream from the leading edge 102 of the portion of plurality of vanes 100, and each of the plurality of vanes 100 having an outer free edge 106. The intake housing 76 includes an outer wall 108, defining an inner surface 110 and an intake opening 112 for gas, such as air, to enter and pass through the compressor wheel 96 and into the passage 66 in the intake manifold 64 of the engine 10. The intake opening 112 is restricted by an inner wall 116 defining an inner surface 118 and an outer surface 120 having a snap ring groove 122 positioned therein. The inner wall 116 forms a primary inlet 124 through which air enters from the intake opening 112 into the compressor wheel 96. The inner surface 118 of the inner wall 116 is in close proximity to and similar in contour to the outer free edge 106 of the blades or vanes 100. The inner wall 116 extends a short distance upstream from the blades 100 of the compressor wheel 96 to form an annular space or chamber 126 between the inner surface 110 of the outer walls 108 and the outer surface 120 of the inner wall 116. The annular chamber 126 partly surrounds the compressor wheel 96. An annular slot 128 is formed in the inner wall 116 and communicates between the annular chamber 126 and the primary inlet 124. A means 129 for connecting is interposed the annular chamber 126 and the contour of the spacing between the blades 100 within the primary inlet 124 forming a secondary inlet 130 in which air can enter from the inlet opening 112 into the annular chamber 126 and further into the compressor wheel 96. As best shown in FIG. 3, a series of webs 132 bridge the annular slot 128 at intervals around its, circumference and support the inner wall 116. In this application, three webs 132 are equally spaced about the annular chamber 126 dividing the annular chamber 126 into three equal sectors.

Figure 4:
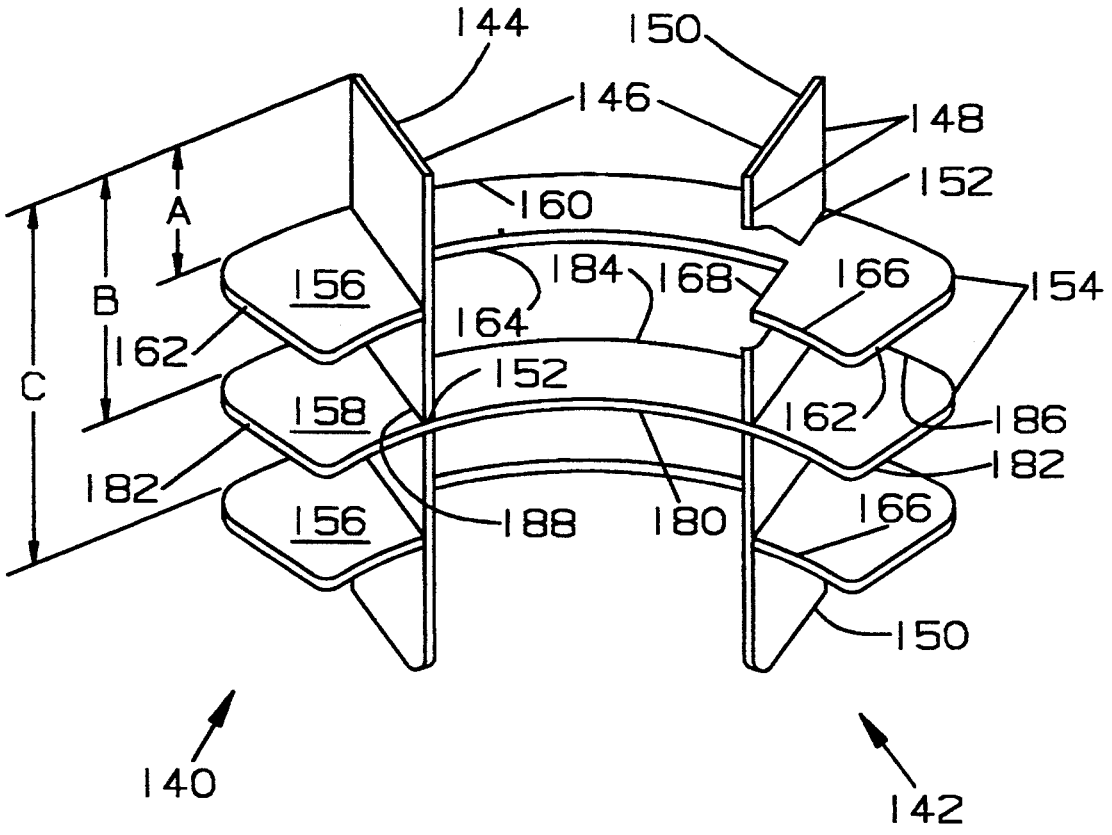
FIG. 4 is an enlarged isometric view of an embodiment of a noise reduction system of the present invention.

As best shown in FIGS. 2, 3, 4 and 5, a means 140 for reducing noise emitted from the turbocharger 70 includes a passive noise reduction system 142 positioned in axial alignment with the annular chamber and within the annular chamber 126. The noise reduction system 142 includes a plurality of deflector assemblies 144. For example in this application, one deflector assembly 144 is positioned in each of the three sectors. As an alternative, a single deflector assembly 144 could be assembled in a manner in which it could be fitted into the annular chamber 126 regardless of the number of webs 132 and sectors. Each deflector assembly 144 includes a pair of supports 146 having a generally rectangular shape defining a pair of long sides 148 and a pair of short ends 150. In this application, the pair of long sides 148 are tapered. One of the pair of long sides 148 has a single notch 152 positioned therein and the other of the pair of long sides 148 has a pair of notches 152 positioned therein. The position of the notches 152 along the long sides 148 has a preestablished spacing. For example, as shown in FIG. 4, the spaces designated by A, B, C are generally determined by the following formula:

$$A,B,C = \frac{N \times 10{,}440{,}000}{S \times B}$$

N=1,2,3, . . .

S=Turbocharger Speed for Max. Reduction (RPM)

B=Number of Main Blades

In this application for example, the spacing designated by A, B, and C are respectively generally 28 mm, 56 mm, and 84 mm. The turbocharger speed for maximum reduction is about 62,000 revolutions per minute and the number of main blades are 6.

Each of the pair of supports 146 are positioned within the annular chamber 126 with the long sides 148 coaxial with the axis 72 and spaced a preestablished distance one from the other. The pair of supports have a series of deflector fins 154 positioned in the notches 152 which results in the series of deflector fins 154 being spaced apart a preestablished distance. The fins 154 have a generally arcuate shape to generally match the contour of the annular chamber 126. In this application, three fins 154 are used and include a pair of outer fins 156 and an inner fin 158. The contour of the pair of outer fins is defined by an outer radiused portion 160, a pair of ends 162 having the corners shaped to fit closely with respect to the walls of the annular chamber 126, an offset inner radiused portion 164 blendingly connected between the pair of ends 162 by an inner radiused portion 166 and a radial segment 168. The contour of the inner fin 158 is defined by an inner radiused portion 180, a pair of ends 182 having the corners shaped to fit closely with respect to the walls of the annular chamber 126, an offset outer radiused portion 184 blendingly connected between the pair of ends 182 by an outer radiused portion 186 and a radial segment 188.

As a further alternative, one, two or any number of fins 154 could be used to cause a tortuous path for the noise emitted from the annular slot 128. Furthermore, a single fin 154 or a plurality of fins 154 could be formed as an integral part of the turbocharger 70 without changing the gist of the invention.

Figure 5:
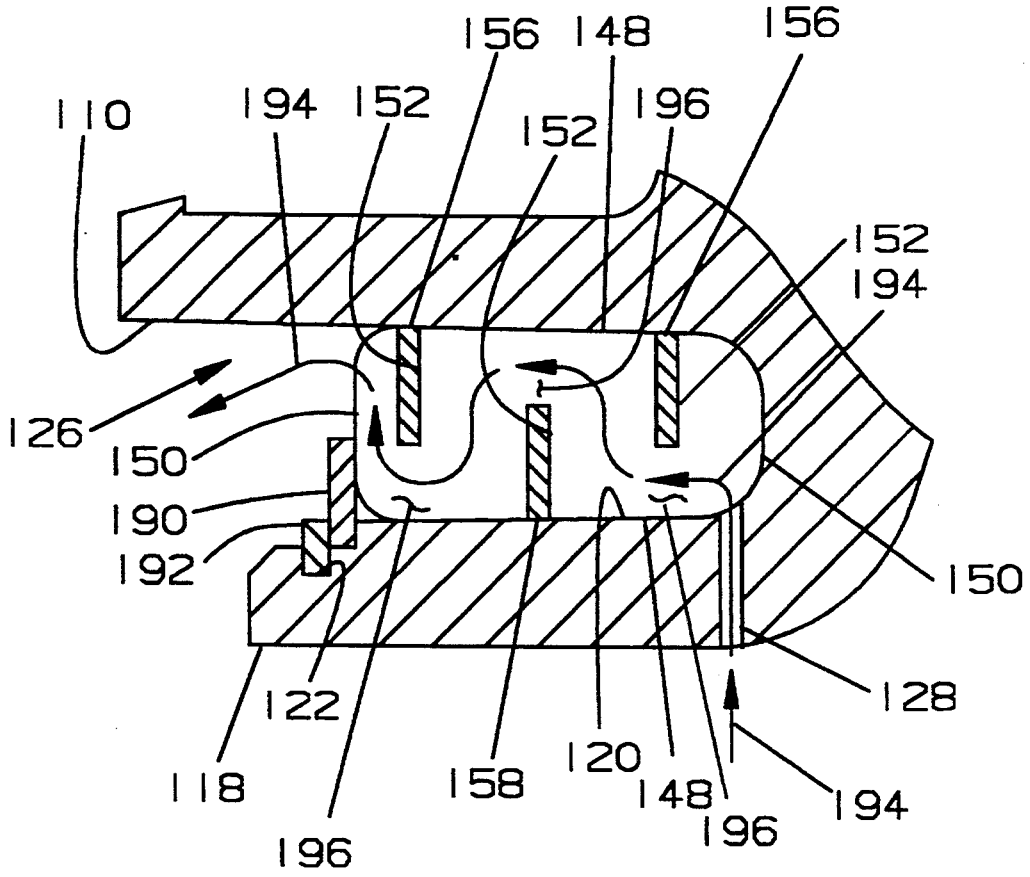
FIG. 5 is an enlarged sectional view of a portion of the turbocharger and the embodiment of the present invention as shown in FIG. 2.

As best shown in FIGS. 2, 3 and 5, the plurality of deflector assemblies 144 are positioned within the annular chamber 126. A large washer 190 is positioned over the outer surface 120 of the inner wall 116 and a snap ring 192 is positioned in the snap ring groove 122 in the outer surface 120 of the inner wall 116. As an alternative, the deflector assembly 144 could be retained in the annular chamber 126 by a variety of methods such as glue, friction tabs, bendable tabs, etc. Thus, the plurality of deflector assemblies 144 are positioned within the three sectors of the annular chamber 126. Each of the deflector assemblies 144 form a torturous path, illustrated by arrows 194, as shown in FIG. 5. A plurality of spaces 196 are formed between the offset inner radiused portion 164 of the pair of outer fins 156 and the outer surface 120 of the inner wall 116, and the offset outer radiused portion 186 of the inner fin 158 and the inner surface 110 of the outer wall 108.

Figure 6:
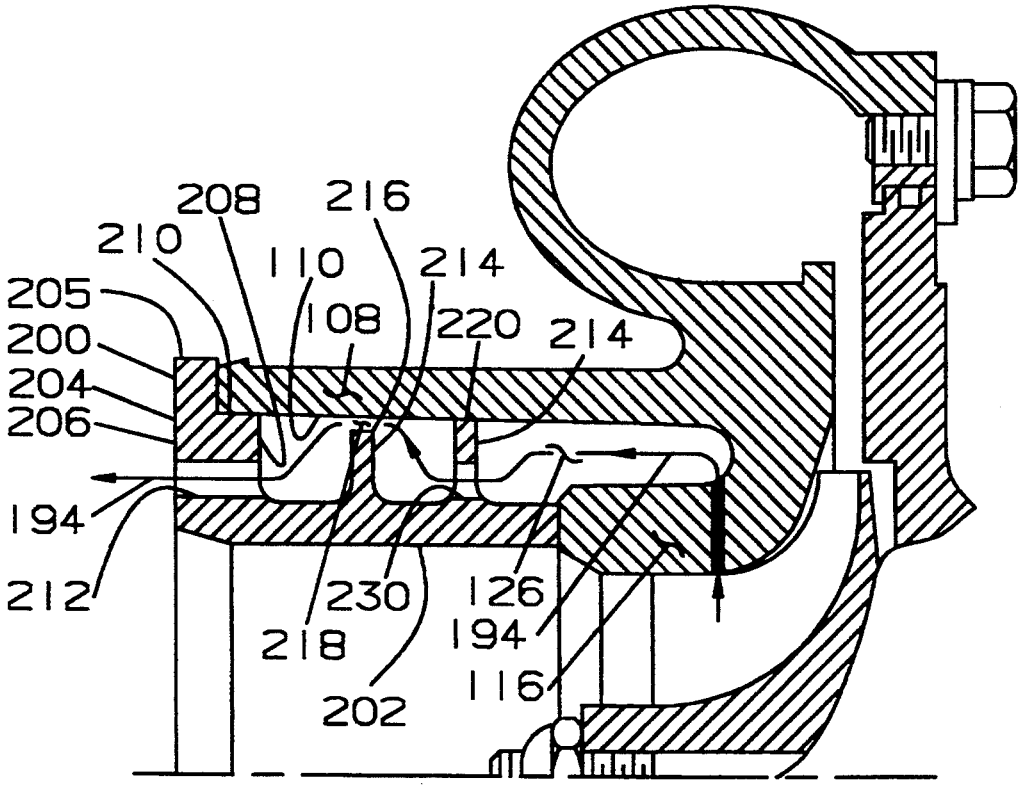
FIG. 6 is an enlarged sectional partial view of an alternative embodiment of the present invention.
Figure 7:
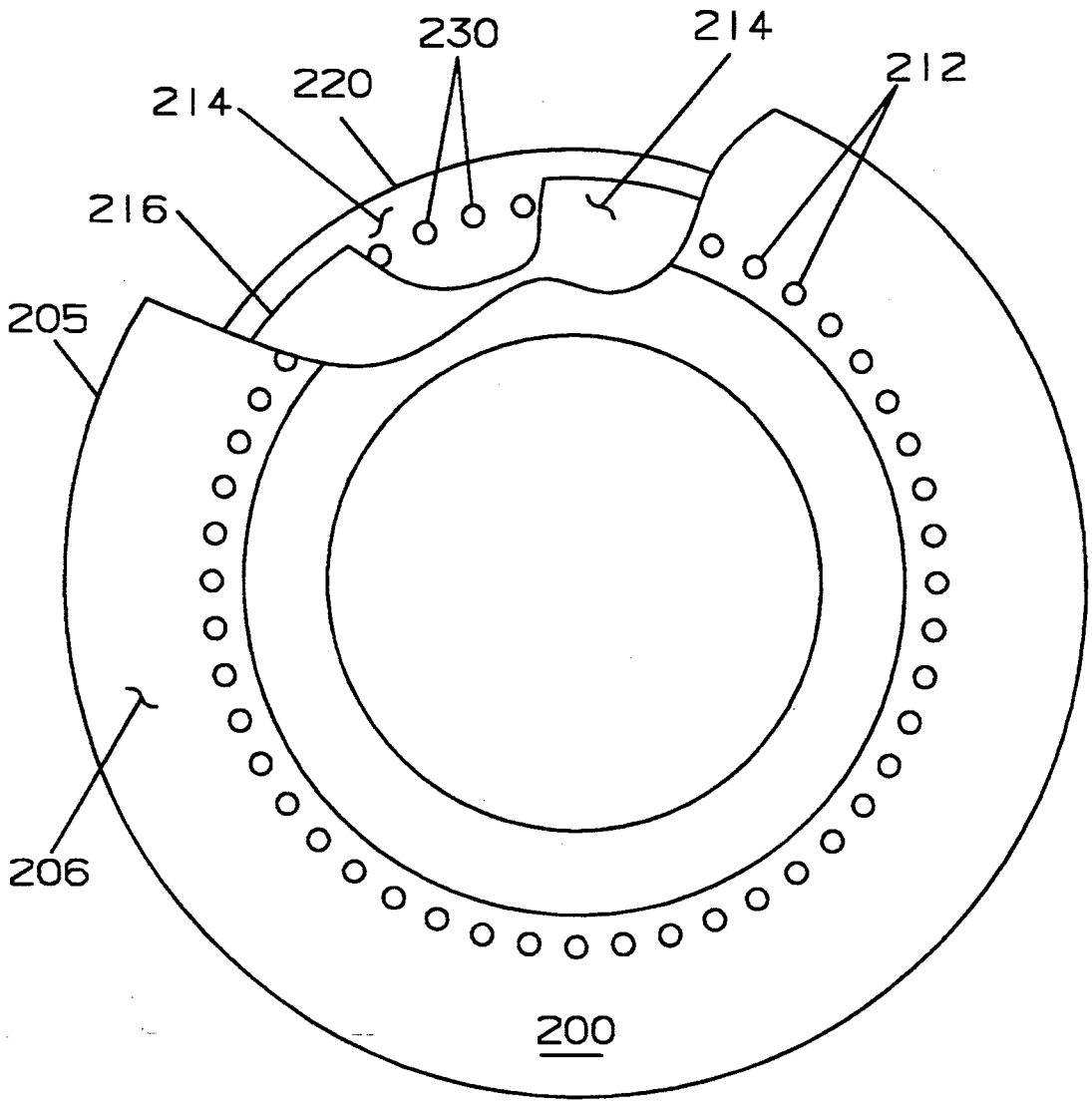
FIG. 7 is an end view of the alternative embodiment of FIG. 6.

As an alternative, best shown in FIG. 6, the torturous path, shown by arrows 194, formed by an annular deflector assembly 200 is positioned in axial alignment with the annular chamber 126 within the inlet 112 and the noise emitted therefrom will be reduced. For example, the annular deflector assembly 200 includes a generally cylindrical portion 202 having an end in abutment with an end of the inner wall 116 and a radially disposed stepped flange 204 is attached at the other end. An outer surface 205 of the flange 204 extends slightly beyond the extremity of the outer wall 108 a preestablished distance. The radial stepped flange 204 defines an inlet end surface 206 and an annular groove end surface 208. Interposed the inlet end surface 206 and the annular groove end surface 208 is a stepped portion 210 being fitted in contacting relationship with the inner surface 110 and abutting with the end of the outer wall 108. As best shown in FIG. 7, extending between the inlet end surface 206 and the annular groove end surface 208, and being radial positioned between the cylindrical portion 202 and the stepped portion 210 is a series of holes 212. As an alternative, best shown in FIG. 8, the series of holes 212 could be formed by a groove 213 or plurality of grooves extending between the inlet end surface 206 and the annular groove end surface 208. In this alternative, a pair of annular radial flanges 214 extend from the cylindrical portion 202 toward the inner surface 110 of the outer wall 108. However, as a further alternative, at least a single flange could be used without changing the gist of the invention. The pair of flanges 214 are axially spaced apart a preestablished distance as defined above. A first of the pair of flanges 214 nearest the stepped flange 204 defines a radial outer surface 216 having a preestablished radius and forms a space 218 between the outer surface 216 and the inner surface 110 of the outer wall 108. A second of the pair of flanges 214 positioned further away from the stepped flange 204 defines a radial outer surface 220 which is in close proximity to or in light contact with the inner surface 110 of the outer wall 108. Extend through the second of the pair of flanges 214 and being radial positioned between the cylindrical portion 202 and the outer surface 220 is a series of holes 230. As an alternative the series of holes 230 could be formed by a groove 231 or plurality of grooves extending through the second of the pair of flanges 214.

INDUSTRIAL APPLICABILITY

In use, the engine 10 is started and the rotation of the crankshaft 20 causes the piston 18 to reciprocate. As the piston 18 moves into the intake stroke, the pressure within the bore 16 is lower than atmospheric. Furthermore, rotation of the compressor wheel 96 draws air from the atmosphere increasing the density of the air. In general, the air then passes through the intake passage 36, around the intake valve 40 in the open position 42 and enters the bore 16. Fuel is added in a conventional manner and the engine 10 starts and operates. As the engine 10 is operating, after combustion has occurred, the exhaust gasses pass around the exhaust valve 46 in the open position 48, into the passage 62 in the exhaust manifold 60 and enter the exhaust housing 74 of the turbocharger 70. The energy in the exhaust gasses drives the turbine wheel 94 rotating the shaft 92 and the compressor wheel 96 to increase the density and volume of incoming combustion air to the engine 10.

At low engine speeds and low load, the energy in the exhaust gases drives the turbocharger 70 at a low speed. As the engine is accelerated and/or the load increased, the energy in the exhaust gasses increases and the turbocharger is continually driven at a higher speed until the engine reaches maximum RPM or load. At low engine speeds, the quantity of intake air required by the engine is low and as the speed and power requirements increase the quantity of intake air needed is increased.

In more detail within the turbocharger 70 at high speeds, air is drawn into the compressor wheel 96 through the primary inlet 124 and the pressure within the annular chamber 126 is lower than atmospheric. As the compressor wheel 96 rotates, the leading edge 102 and offset leading edge 104 of the blades 100 contacts the incoming air, the air is driven through the blade configuration to the trailing edge and exits therefrom. The pressure between the blades 100 within the primary inlet 124 along the blade configuration is low and additional air is drawn in through the secondary inlet 130. Thus, air flows inwardly through the annular slot 128 from the annular chamber 126 into the spacing between the blades 100 of the compressor wheel 96. The result being, increasing the amount of air reaching the compressor wheel 96 and increasing the maximum flow capacity therefrom. As the flow through the compressor wheel 96 decreases or drops, the amount of air drawn into the compressor wheel 96 through the annular slot 128 decreases until equilibrium is reached. Further dropping of the compressor wheel 96 speed results in the pressure along the blade configuration of the compressor wheel 96 to be greater than in the annular chamber 126 and thus, air flows outward through the annular slot 128 into the annular chamber 126. The air bleeding out of the compressor wheel 96 is recirculated into the primary inlet 124. An increase in flow or speed of the compressor wheel 96 causes the reverse to happen, i.e., a decrease in the amount of air bled from the compressor wheel 96 followed by equilibrium and air being drawn into the compressor wheel 96 via the annular slot 128. This particular arrangement results in improved stability of the compressor air flow and pressure at all speeds and a shift in the characteristics of the compressor improving surge and flow capacity.

Due to the presence of the annular slot 128 noise generated by the plurality of vanes 100 passes through the annular slot 128 into the annular chamber 126, resulting in increased noise emitted from the turbocharger 70. To resolve this problem, the means 140 for reducing noise emitted from the turbocharger 70 is used. For example, the plurality of deflector assemblies 142 are positioned in the annular chamber 126. Each of the deflector assemblies 142 are secured therein. Thus, the noise which passes through the annular slot 128 and into the annular chamber 126 must follow the torturous path, shown by arrows 194, reducing the noise emitted from the turbocharger 70. In operation, the flow of noise passing into the annular chamber 126 contacts one of the pair of outer fins 156 reflects therefrom expending some of the noise energy. After bouncing around, the noise energy passes through the space 196 between the outer fin 156 and the outer surface 120 of the inner wall 116. The flow of noise energy contacts the inner fin 158 reflects therefrom and additional energy is expended. After bouncing around, the noise energy passes through the space 196 between the inner fin 158 and the inner surface 110 of the outer wall 108. The noise energy continues to flow until it contacts the other of the pair of outer fins 156 reflects therefrom and additional energy is expended. After bouncing around, the noise energy passes through the space 196 between the outer fin 156 and the outer surface 120 of the inner wall 116. A variation in the number of outer fins 156 and inner fins 158 (more or less) may be used as required to reduce the noise, limited only by the space in the annular chamber 126.

To further enhance the reflection mode of the noise energy, the fins 156,158 have a preestablished spacing therebetween. The spacing is established so that a portion of the noise energy which is reflecting from the inner fin 158 toward the outer fin 156 interferes with a portion of the noise energy reflecting from the outer fin 156 toward the inner fin 158. Thus, the effectiveness of the means 140 for reducing noise emitted from the turbocharger 70 is increased.

Figure 8:
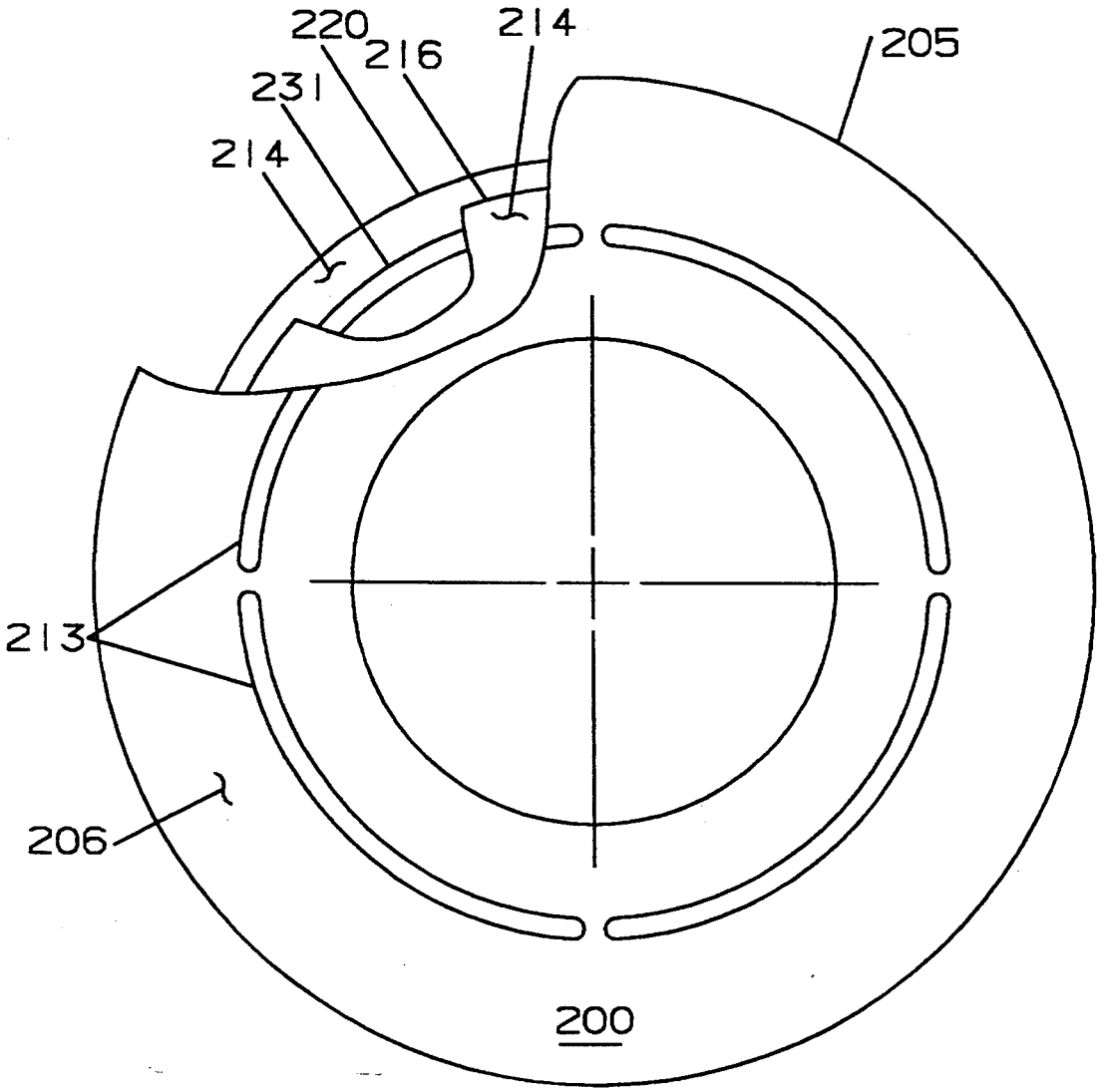
FIG. 8 is an end view of a further alternative embodiment of FIG. 6.

If the alternative shown in FIG. 6, 7 or 8 is used to reduce the noise emitted from the turbocharger 10, the annular deflector assembly 200 is positioned in the inlet opening 112 and is axially aligned with the annular chamber 126. For example, an end of the cylindrical portion 202 is positioned in contacting relationship to the end of the inner wall 116 and the stepped flange 204 has the stepped portion 210 fitted in contacting relationship with the inner surface 110 and abuts with the end of the outer wall 108. Thus, the torturous path, shown by arrows 194, is established. The noise passes through the annular slot 128 and enters the annular chamber 126. The noise travels along the annular chamber 126, contacts the second of the pair of flanges 214 and flows through the series of holes 230 in the second of the pair of flanges 214. The noise further travels to the first of the pair of flanges 214 and passes through the space 218 and after contacting the stepped flange 204 exits the series of holes 212 in the stepped flange 204. This torturous path reduces the noise emitted from the turbocharger.

Other aspects, objects and advantages will become apparent from a study of the specification, drawings and appended claims.

We claim:

1. A turbocharger comprising:

an intake housing having an outer wall defining an intake opening therein and an inner wall positioned within the outer wall;

a primary inlet formed within the inner wall;

an annular chamber formed between the outer wall and the inner wall;

a means for connecting interposed the annular chamber and the primary inlet forming a secondary inlet; and a means for reducing noise emitted from the turbocharger, said means for reducing being positioned in generally axial alignment with the annular chamber.

2. The turbocharger of claim 1 wherein said means for reducing noise emitted from the turbocharger is a passive noise reduction system.

3. The turbocharger of claim 2 wherein said passive noise reduction system includes a deflector assembly.

4. The turbocharger of claim 3 wherein said deflector assembly includes a plurality of deflector assemblies.

5. The turbocharger of claim 4 wherein each of said plurality of deflector assemblies include a series of deflector fins.

6. The turbocharger of claim 5 wherein said series of deflector fins have a preestablished space therebetween.

7. The turbocharger of claim 6 wherein said series of deflector fins includes a pair of outer fins and an inner fin.

8. The turbocharger of claim 5 wherein said series of deflector fins each have a generally arcuate shape.

9. The turbocharger of claim 3 wherein said deflector assembly includes at least a single deflector fin.

10. The turbocharger of claim 1 wherein said annular chamber is divided circumferentially into a plurality of sectors.

11. The turbocharger of claim 2 wherein said passive noise reduction system forms a torturous path within the annular chamber.

12. The turbocharger of claim 2 wherein said passive noise reduction system is positioned in the annular chamber.

13. The turbocharger of claim 1 wherein said means for connecting interposed the annular chamber and the primary inlet includes an annular slot.

14. The turbocharger of claim 1 wherein said means for reducing is removably positioned in the annular chamber.

15. A turbocharger housing for reducing levels of noise produced by a turbocharger, the turbocharger including a compressor wheel having a number of main blades, the compressor wheel being rotationally disposed within said turbocharger housing and defining a central axis therefor, the turbocharger housing comprising:

an inner wall including a first inner surface and an outer surface, said first inner surface being in close proximity to and similar in contour to the compressor wheel;

an outer wall disposed about said inner wall, said outer wall including a second inner surface spaced radially outward from said outer surface to define an annular chamber therebetween;

a fluid passageway extending across said inner wall between said outer surface and said first inner surface, said fluid passageway fluidly coupling said annular chamber with said compressor wheel;

a deflector assembly removably disposed in said annular chamber between second inner surface and said outer surface, said deflector assembly defining a circuitous flowpath across said annular chamber; and means for retaining said deflector assembly in said annular chamber.

16. The turbocharger housing of claim 15, wherein said deflector assembly includes a number of axially spaced fins defining an axially circuitous flowpath across said annular chamber.

17. The turbocharger housing of claim 16, wherein said number of axially spaced fins define a preestablished spacing therebetween according to the following relationship:

$$\text{Spacing} = \frac{N \times 10{,}440{,}000}{S \times B}$$

wherein said preestablished spacing is a function of the number of spaces 'N' between said number of axially spaced fins, the rotational speed 'S' (RPM) of said compressor wheel, and the number of main blades 'B' of said compressor wheel.

18. The turbocharger housing of claim 15, wherein said means for retaining said deflector assembly in said annular chamber includes a groove disposed in one of said outer wall and said second inner wall and a retaining ring disposed in said groove, said retaining ring trapping said deflector assembly in said annular chamber.

19. The turbocharger of claim 15, wherein:

said fluid passageway includes an annular slot;

said inner wall is supported from said outer wall by a number of circumferentially spaced webs; and said deflector assembly includes a number of deflector assemblies disposed between said number of circumferentially spaced webs.

20. A method for reducing levels of noise produced by a turbocharger, the turbocharger including a compressor wheel rotationally disposed within a turbocharger housing and defining a central axis therefor, the turbocharger housing including an inner wall in close proximity to the compressor wheel and an outer wall spaced radially outward from the inner wall to define an annular chamber therebetween, the annular chamber being in fluid communication with the compressor wheel, the method comprising the steps of:

placing a removable deflector assembly in the annular chamber between the inner wall and the outer wall, said deflector assembly defining a circuitous flowpath across the annular chamber; and retaining the removable deflector assembly in place in the annular chamber.

21. The method for reducing levels of noise produced by a turbocharger of claim 20, wherein the inner wall is supported from the outer wall by a number of circumferentially spaced webs extending across the annular chamber and in the step of placing a removable deflector assembly in the annular chamber between the inner wall and the outer wall, a number of removable deflector assemblies are placed in the annular chamber between the circumferentially spaced webs.

22. The method for reducing levels of noise produced by a turbocharger of claim 21, wherein in the step of retaining the removable deflector assembly in place in the annular chamber, a retaining ring groove is provided in one of the inner wall and outer wall and a retaining ring is placed in said retaining ring groove to trap said deflector assemblies in place in the annular chamber between the circumferentially spaced webs.

* * * * *